US006120617A

United States Patent [19]

Hausch et al.

[11] Patent Number: 6,120,617

[45] Date of Patent: Sep. 19, 2000

[54] METHOD FOR MANUFACTURING A MAGNETIC PULSE GENERATOR

[75] Inventors: Gernot Hausch, Langensebold; Christian Radeloff, Bruchkoebel 1; Gerd Rauscher, Alzenau, all of Germany

[73] Assignee: Vacuumschmelze GmbH, Hanau, Germany

[21] Appl. No.: 08/224,074

[22] Filed: Apr. 7, 1994

Related U.S. Application Data

[62] Division of application No. 08/009,668, Jan. 27, 1993, abandoned.

[30] Foreign Application Priority Data

Jan. 28, 1992 [DE] Germany ..... 42 02 240

[51] Int. Cl.[7] ..... H01F 3/00

[52] U.S. Cl. ..... 148/121; 148/306; 148/312; 428/611; 428/678; 428/679; 428/928; 307/106

[58] Field of Search ..... 148/120, 121, 148/306, 312; 428/611, 678, 679, 928; 307/106

[56] References Cited

U.S. PATENT DOCUMENTS 4,660,025 4/1987 Humphrey ..... 340/572
4,950,550 8/1990 Radeloff et al. ..... 428/611

FOREIGN PATENT DOCUMENTS 29 33 337 3/1981 Germany .
31 52 008 7/1983 Germany .
34 11 079 9/1985 Germany .

OTHER PUBLICATIONS

"The Physical Metallurgy of Maraging Steels", Floreen, S., Metallurgical Reviews, vol. 13 No. 126, pp. 115–12B, 1968.

"Ein extrafester Maraging–Stahl mit 250 kp/mm$^2$ Zugfestigkeit." Scheidl, Radex–Rundschau, 1972, vol. 3/4 pp. 212–215.

Einfluss wiederholter Phasenübergänge auf die γ=ϵ–Umwandlung in austenitischen Manganstählen, Schumann, et al., Zeitschrift für Metallkunde, vol. 56, No. 3 (1965) pp. 165–172.

*Primary Examiner*—Sikyin Ip
*Attorney, Agent, or Firm*—Hill & Simpson

[57] ABSTRACT

For manufacturing a pulse generator wherein a voltage pulse dependent on the change in magnetic field can be achieved by sudden magnetic reversal (Barkhausen skip) given an applied magnetic field, an iron alloy is employed for one of the materials of the composite member, the additional alloy constituents of this iron alloy being selected such that a structural conversion with volume change respectively occurs at different temperatures. For producing the stressed condition, a thermal treatment is then implemented, which includes heating above the upper transition temperature and a cooling below the lower transition temperature. As a result, substantially greater stresses between the materials of the composite member arise, causing a pulse behavior significantly improved in comparison to known pulse generators of the type capable of recognizing constant or alternating magnetic fields.

13 Claims, 3 Drawing Sheets

FIG. 5
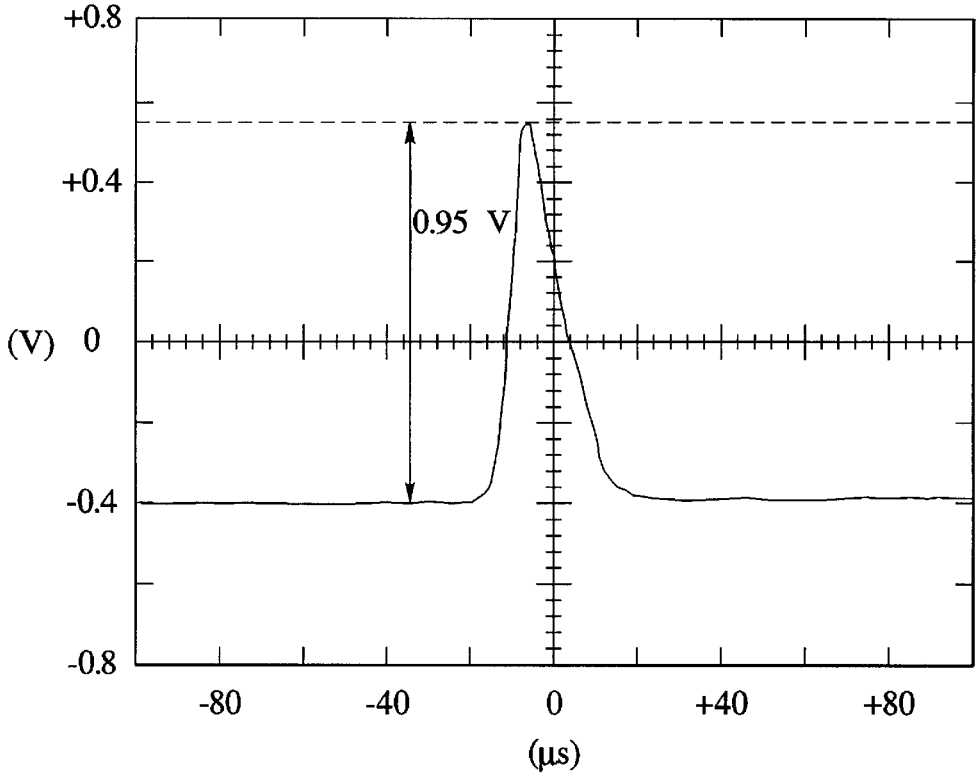
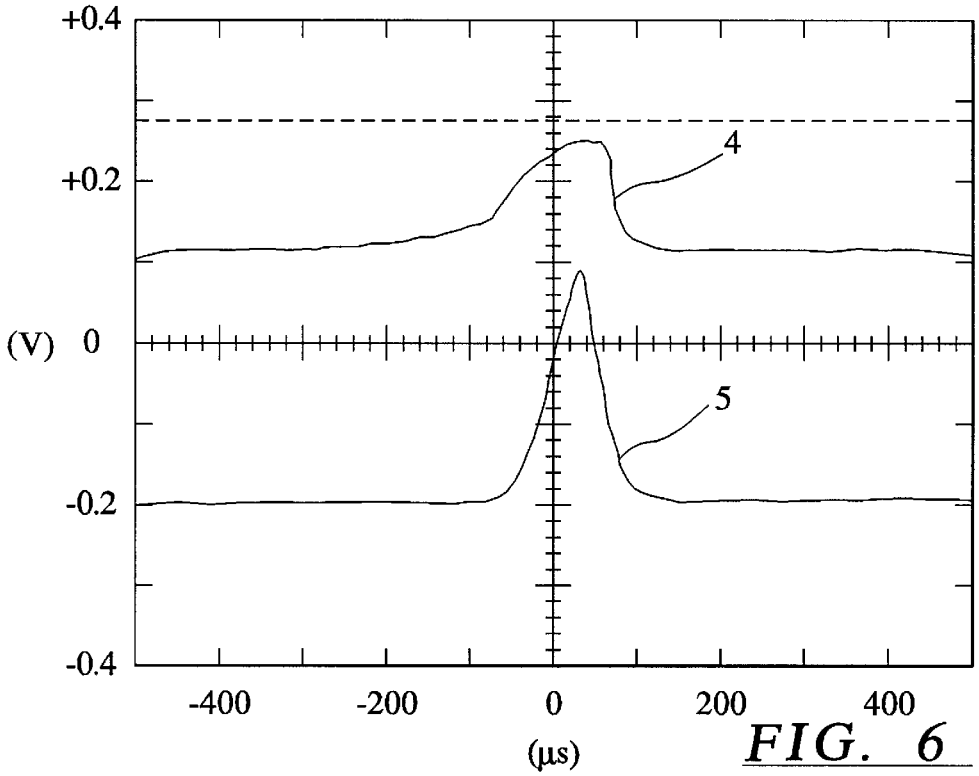
FIG. 6

METHOD FOR MANUFACTURING A MAGNETIC PULSE GENERATOR

This is a division, of application Ser. No. 08,009,668, filed Jan. 27, 1993, now abandoned.

BACKGROUND OF THE INVENTION

1. Field of the Invention

The present invention is directed to a method for manufacturing a pulse generator that acts on the basis of sudden reversal of the magnetic poles given an applied magnetic field, of the type wherein the pulse generator is formed by an elongated composite member of at least two materials that have different thermal expansion behavior and are mechanically braced relative to one another by means of a thermal treatment.

2. Description of the Prior Art

German Patent 31 52 008 discloses a pulse generator formed by a composite member operating as described above. This composite member contains a core and a jacket or envelope whose materials can partially or completely consist of magnetic materials having different coercive field strengths. Given the employment of two magnetic materials with different coercive field strength, an alloy in the range, for example, of 45 through 55% cobalt by weight, 30 through 50% iron by weight and 4 through 14% chromium plus vanadium by weight is employed for the magnetically harder material, whereas nickel is provided as the soft-magnetic material. A defined tension state is produced with a thermal treatment in this known pulse generator by incorporating a material constituent having shape memory or by employing materials having different coefficients of thermal expansion, this tension state yielding a sudden reversal of the magnetic poles in the stressed, soft-magnetic constituent of the composite member, in the presence of the influence of an external magnetic field.

This known composite member exists as an elongated magnetic switch core.

German Published Application 29 33 337 discloses the use of a composite member composed of nickel or unalloyed steel as a bracing or stressing constituent and the use of a cobalt—vanadium—iron alloy as a magnetically active switch component. A thermal treatment is implemented in the manufacture of this known component. First, the wire, which preferably constitutes the composite member, is heated to such an extent that one material constituent plastically deforms under the arising stresses, so that these stresses are largely dismantled. During subsequent cooling, the different coefficients of thermal expansion in turn cause mechanical stresses to arise that, due to the lower temperature, no longer lead to a plastic deformation and, due to the magnetostriction of the magnetically active constituent, lead to the sudden reversal of the magnetic poles in the magnetically active constituent when a specific magnetic field is applied.

An elongated composite member having a low response field strength of 1.0 Oe (approximately 0.8 A/cm) is disclosed in U.S. Pat. No. 4,660,025. For example, an elongated wire of amorphous material that is 7.6 cm long is disclosed therein and it is recited that the length of this wire can be between 2.5 and 10 cm. The internal stresses derived by quenching the material in the production of the amorphous state are the cause of the magnetic skip behavior.

German OS 34 11 049 employs a combination of hard-magnetic and soft-magnetic alloys for manufacturing the composite member. From aforementioned German Patent 31 52 008 it is known that the hard-magnetic constituent can simultaneously serve the purpose of stressing the soft-magnetic constituent. This structure has the advantage that a wire having a high-strength cladding is obtained and that relatively short wires can be provided.

The magnetization characteristic shifts due to the magnetization of the hard-magnetic cladding of a composite member, so that demagnetization zones at the edge of the strip are largely avoided due to the flux in the hard-magnetic cladding, resulting in a skip-like reversal of the magnetic poles (Barkhausen skip), given the reversal of the magnetic poles in one direction, whereas this Barkhausen skip is absent given a reversal of the magnetic poles in the other direction. Significantly shorter switch cores can be employed, since the permanent magnet largely prevents demagnetization zones at the ends of the wire (pulse generator).

SUMMARY OF THE INVENTION

It is an object of the present invention to specify a method for manufacturing a pulse generator exhibiting skip behavior as described above which, without additional method steps, yields substantially greater stresses between the materials of the composite member, and thus yields substantially higher voltage pulses given the sudden reversal of the magnetic poles of the active constituent.

A further object of the present invention is to achieve a pre-magnetization of the magnetically active part of the composite member with adequate coercive field strength in addition to achieving the improved pulse behavior, without having to provide an additional strip of permanent magnetic material.

These objects are achieved in accordance with the principles of the present invention by employing an iron alloy as one of the materials for the composite member forming a pulse generator, with additional alloy constituents of this iron alloy being selected such that a structural conversion with volume change respectively occurs at different temperatures. An oblong composite member composed of materials including the iron alloy is subjected to a thermal treatment wherein the composite member is first heated above the upper magnetic transition temperature and is later cooled below the lower magnetic transition temperature.

As used herein, a "structural conversion with volume change" is, for example, a change of the crystal structure due to phase conversion from, for example, the alpha phase (body-centered cubic lattice) into the gamma phase (face-centered cubic lattice) or into the epsilon-phase (hexagonal lattice) and vice versa.

DESCRIPTION OF THE DRAWINGS

FIG. 5 shows the voltage pulse obtainable in a pulse generator constructed in accordance with the principles of the present invention when the magnetic poles of the soft-magnetic core are reversed.

FIG. 6 compares the pulse obtained from a pulse generator constructed in accordance with the principles of the present invention, with a non-magnetized jacket, to that obtained from an amorphous wire that has inner stresses.

DESCRIPTION OF THE PREFERRED EMBODIMENTS

Figure 1A:
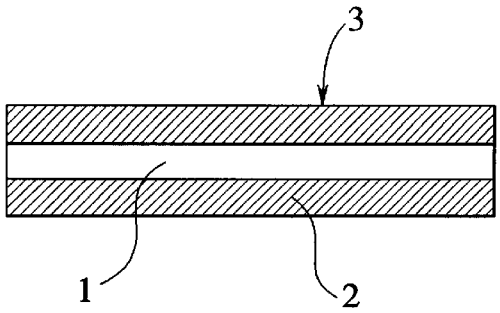
FIG. 1*a* and FIG. 1*b* show a wire-shaped pulse generator constructed in accordance with the principles of the present invention in side and end sections.
Figure 1B:
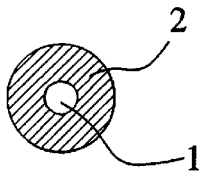

The structural arrangement of a composite member composed of materials, and heat treated in accordance with the invention is shown in FIG. 1. The composite member is in the form of a wire core composed of a soft-magnetic material 1 and a jacket or cladding composed of an iron alloy 2. The coercive force of the iron alloy 2 is thereby higher than that of the soft-magnetic material 1. In the exemplary embodiment, the soft-magnetic material 1 is composed of an alloy having 75.5 Ni, 2.9 Mo, 3.0 Ti, 1.0 Nb, the remainder Fe. In this alloy, the Ti and the Nb serve as hardening additive in order to preclude an easy, plastic deformation of the soft-magnetic material. This soft-magnetic material has a magnetostriction above zero, i.e. the material expands in the magnetization direction. For this reason, the desired skip behavior is achieved when the soft-magnetic material 1 is under tensile stress in the finished pulse generator.

In order to achieve this tensile stress to a significantly greater extent than in known composite members, the jacket is manufactured of an iron alloy that experiences respectively different structural conversions at different temperatures. In the exemplary embodiment, a martensitically hardening steel having the composition 17 Cr, 4 Ni, 4 Cu, 0.4 Nb, the remainder iron, was selected. This is a commercially available, martensitically hardening steel as known, for example, under the designation ARMCO 17-4 PH®, as identified in the brochure "PRODUCT DATA" of Armco Steel Corporation, Baltimore, Md., No. S-6c. Like many other known steels, this iron alloy exhibits structural transformation points between the alpha and gamma structures. The temperature behavior is presented on page 11 of this brochure. One can see from this diagram that a continuous increase in volume up to a temperature of approximately 620° C. first occurs during heating; from this point on, the structural conversion begins, this being accompanied by a reduction in volume up to a temperature of approximately 660° C. From this point on, the volume—and thus, the length of the jacket according to FIG. 1 herein—continues to increase without the occurrence of another conversion or some other anomaly.

After heating this iron alloy above the upper magnetic transition temperature, the alloy can then be cooled, which effects a continuous reduction in volume according to the dashed line shown in the brochure to a temperature of below 200° C. A reconversion of the structure begins at this point, this being utilized in known steels in order to achieve a hardening of the steel. The martensitic "alpha phase" thereby arising prevents the volume from diminishing further to the previous extent given further cooling; on the contrary, it expands further, as the dashed-line curve shows, in the range from 300° through 100° C. (Product Data, Armco 17-4 PH, page 11).

This behavior is inventively utilized herein in order to manufacture a pulse generator that achieves an especially high mechanical stressing of the constituents of a composite member which is intended to experience a sudden reversal of the magnetic poles (Barkhausen skip) given a specific magnetic field. To that end, the composite member 3 in the exemplary embodiment of FIG. 1 is heated to a temperature above 750° C. and is subsequently cooled below 100° C. This results in the fact that the soft-magnetic material 1 and the iron alloy 2 initially expand roughly uniformly (dependent on their coefficients of thermal expansion). When the upper transition temperature of the iron alloy is reached, the soft-magnetic material attempts to expand farther, whereas the iron alloy exhibits diminished expansion, i.e., it shrinks or expands to a lesser degree. As a result, a compressive stress arises in the soft-magnetic material 1 and a tensile stress arises in the iron alloy 2. At the high temperature following the transition, however, this results in the material of the core, which is mechanically substantially softer than that of the jacket, being plastically deformed or recrystallized. Such deformation or recrystallization does not take place for the iron alloy 2—at least not to the same extent. It can therefore be assumed that a compensation of the stresses ensues in the thermal treatment, so that no tensile or compressive stresses between core and jacket are present at the beginning of cooling.

During cooling, the volume of the soft-magnetic material 1 as well as that of the iron alloy 2 initially diminish continuously down to a temperature below 300° C. As in known composite members, certain mechanical stresses arise—dependent on the different coefficients of thermal expansion of the materials for the core and jacket, these mechanical stresses being utilized in known pulse generators for pre-stressing the magnetically active material, but not being critical herein, even though they can have an enhancing effect.

When the range between 300° and 100° C. has been traversed during the cooling process, the martensitic conversion of the iron alloy 2 causes the iron alloy 2 to suddenly attempt to expand greatly, whereas the core of soft-magnetic material 1 attempts to shrink further. This results in a considerable tensile stress acting on the core, and a corresponding compressive stress acting on the jacket. The mechanical hardness of the core composed of a soft-magnetic material 1 is selected such that a substantial plastic deformation no longer ensues at this relatively low temperature, so that high, elastic tensile stresses take effect in the core. In combination with the positive magnetostriction of the soft-magnetic material 1, these cause a significantly faster, suddenly occurring reversal of the magnetic poles at specific magnetic field values than is the case given composite members that are less pre-stressed in known pulse generators.

Instead of the steel having martensitic conversions (selected as an example in FIG. 1), all other iron alloys that experience a corresponding conversion can likewise be employed. For example, "RADEX-RUNDSCHAU" 1972, No. 3/4, pages 212 ff, discloses "Ein extra fester Maraging-Stahl mit 250 kp/mm$^2$ Zugfestigkeit". ("A high-strength Maraging Steel with 250 kp/mm$^2$ Tensile Strength"). The word "maraging" herein denotes "martensitic aging hardening" and indicates that these structural transitions have been employed in the prior art for the different purpose hardening the material in order to obtain especially strong steels for mechanical applications. The temperature curve of one of the described steels is presented on page 216, FIG. 9 of this reference and shows that the structural changes therein also cause an increase in volume given cooling between 200° and 130° C. after sufficiently high heating. The inventor herein have recognized that this increase in volume can be utilized for stressing positively magnetostrictive, soft-magnetic materials in a pulse generator.

In order to utilize the volume change given structural conversion of iron alloys for stressing a soft-magnetic material, it is not absolutely necessary to select alloys that exhibit no further decrease in volume given cooling and at relatively low temperature; alloys can be used that even have an increase in volume in a specific temperature range. It is sufficient when the normal decrease of the volume during cooling changes during the structural conversion. After cooling has been carried out to a point below the lower transition temperature, a subsequent heating below the upper transition temperature will no longer result in a structural change, so that the mechanical stresses produced by the structural change are preserved.

Figure 3:
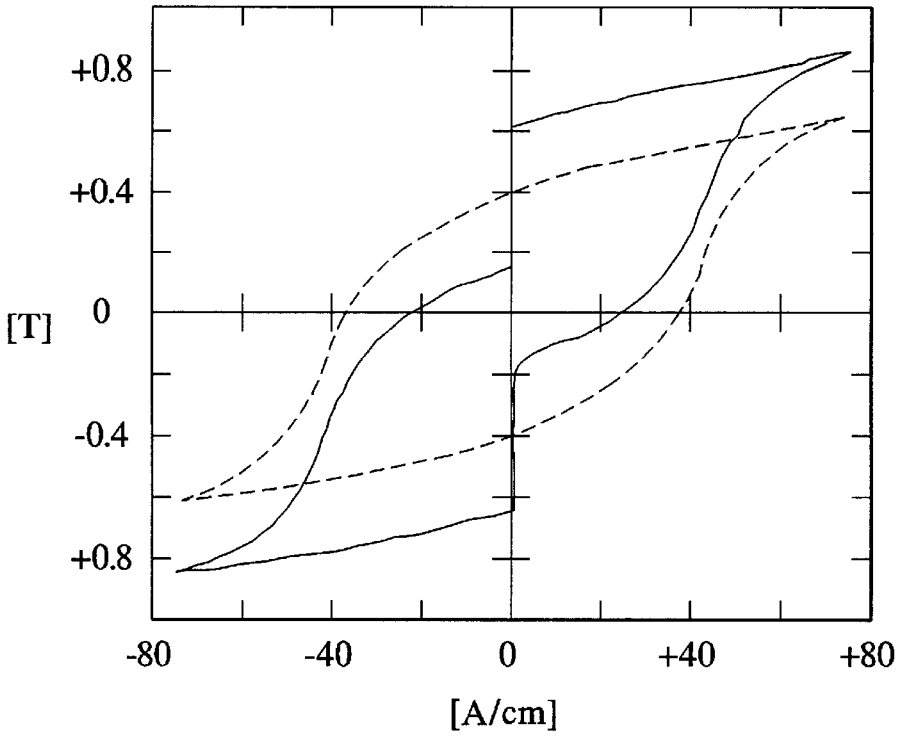
FIG. 3 shows another magnetization curve of the pulse generator of FIGS. 1*a* and 1*b* given full drive thereof, whereby the jacket of the pulse generator is magnetically reversed.

Further, compressive stresses can be produced in a soft-magnetic material when an iron alloy whose volume diminishes when cooled below the lower transition temperature is employed for stressing. This, for example, is known for austenitic manganese steels wherein it is not a gamma-alpha conversion but a gamma-epsilon conversion that occurs. This conversion behavior is described, for example, in "Zeitschift fuer Metalikunde", Vol. 56, 1965 No. 3, pages 165 ff. FIG. 3 on page 167 of this periodical shows the length change in an iron alloy that essentially contains 16.4% Mn in addition to iron. The composition is recited on page 166, left column. It may be seen from FIG. 3 that a continuous increase in volume or length again ensues here given heating (arrow toward the upper right), this being intensified at the conversion between approximately 220° and 280° C.

When a composite member having this material is employed for manufacturing a pulse generator, the composite material is again heated above this conversion temperature during the thermal treatment to such an extent that a compensation of stresses again ensues due to plastic deformation or due to recrystallization. A cooling would then causes the material to contract to a substantially greater extent in the reconversion between 100° and 20° C. then is the case given the magnetic material 1, so that this soft-magnetic material 1 comes under compressive stresses, since the iron alloy shrinks to a greater extent than does the soft-magnetic material. The iron alloys described herein can thus be employed as a soft-magnetic material having negative magnetostriction in order to manufacture a pulse generator having sudden reversal of the magnetic poles with a given magnetic field.

Preferably, the lower transition temperature lies below 600° C., since it is then more likely to be assured that the stresses that have been introduced are not dismantled by relaxation processes or plastic deformation.

It is also possible to employ iron alloys wherein the lower transition temperature lies below room temperature. In order to manufacture a composite member having good stressing with such a material, cooling must be carried out to a point below this transition temperature, at least briefly. When the material then again heats to room temperature but does not reach the upper transition temperature, the stressing is preserved, since it behaves similar to the material of the stressed, soft-magnetic material given temperature changes.

Such alloys are described in the periodical "METALLURGICAL REVIEWS", 126, pages 115 ff., such alloys having a composition of 5% through 25% Ni up to 15% of one or more Co, Mo, Al and Ti, and a remainder Fe, by weight. The diagram in FIG. 4 on page 118 shows that the lower transition temperature in the case of an iron alloy having 29.7% Ni and 6% Al initially lies below room temperature after an aging annealing at 700° C., dependent on the time of this annealing. One can see from this figure, however, that the lower transition temperature also lies above room temperature given an adequately long duration of the treatment at, for example, 700° C.

Figure 2:
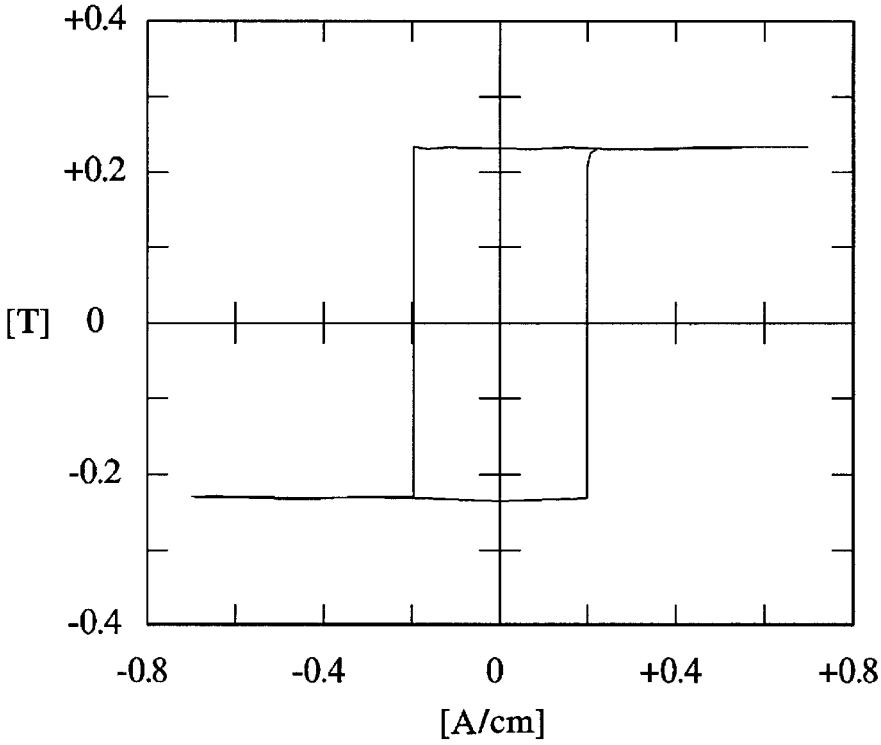
FIG. 2 shows a magnetization curve for the pulse generator of FIGS. 1*a* and 1*b* given full drive thereof, whereby the magnetic poles of the jacket of the pulse generator are reversed.

An extremely good, pronouncedly rectangular magnetization curve, as shown in FIG. 2 herein, is then achieved with the initially cited example having high stressing of the soft-magnetic material 1. The induction is shown on the ordinate, as is conventional, and the field strength in the region of ±0.8 A/cm is shown on the abscissa. The magnetization of the iron alloy 2 remains essentially unaltered in this range of drive. The magnetization skip of the soft-magnetic material 1 is triggered at approximately ±0.2 A/cm.

FIG. 3 shows another corresponding magnetization curve. Here, the field strength drive was between ±80 A/cm, this field strength also being adequate to completely reverse the magnetic poles of the iron alloy employed as the jacket. The induction skip at approximately a field strength of 0 may be seen, which occurs due to the sudden reversal of the magnetic poles of the prestressed soft-magnetic material 1. One can see that the iron alloy serving the purpose of stressing the soft magnetic material 1 has a coercive force of approximately 39 A/cm, as shown by the dashed-line curve in FIG. 3 that contains the hysteresis loop of the iron alloy under compressive stresses. This dashed-line curve was calculated by parallel shift of the measured curve of the composite member.

A comparison to the product brochure "PRODUCT DATA ARMCO 17-4 PH", page 12, shows that the iron alloy employed in the above example normally has a coercive field strength of ±20 Oe=±16 A/cm. This significant increase in the coercive field strength of the iron alloy compared to the value usually measured at this material probably derives due to the brief-duration, high heating of the material in combination with the compressive stresses that it experiences as part of the composite member as a reaction to the tensile stress of the soft-magnetic material. This demonstrates another significant advantage of employing iron alloys in combination with a thermal treatment that exploits the structural conversions with volume change for stressing the soft-magnetic material, since an additional permanent magnet need not be provided now for producing an adequate pre-magnetization of the composite member.

Figure 4:
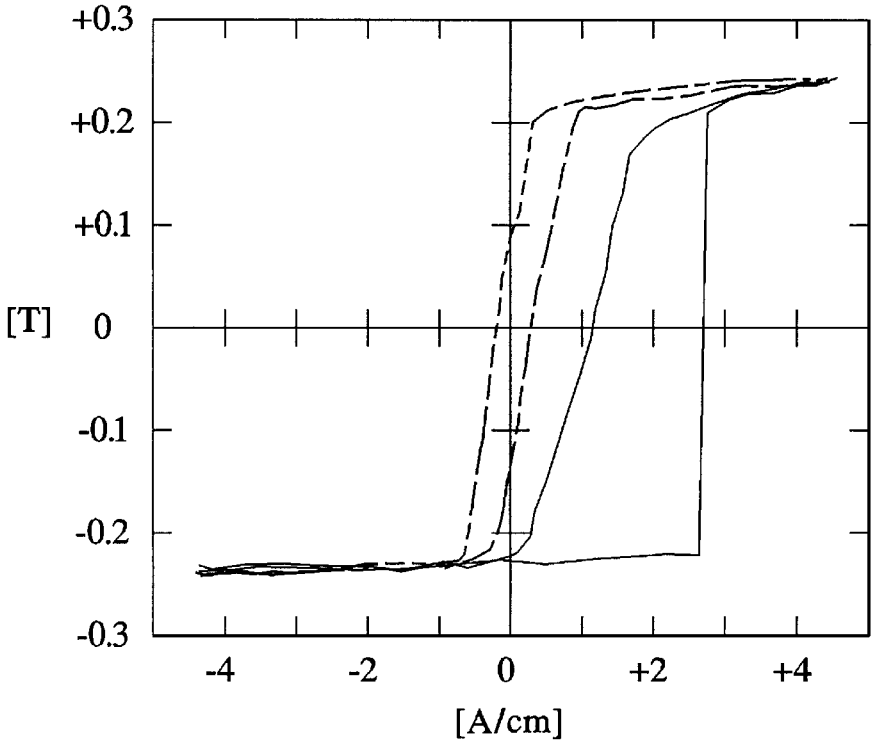
FIG. 4 shows a magnetization curve of a substantially shortened pulse generator constructed in accordance with the principles of the present invention, with and without a magnetized jacket.

This additional pre-magnetization is advantageous, and is required, when one wishes to employ short wires as pulse generator. Given relatively short wires, the inherent, demagnetizing field is highly pronounced, as disclosed in detail in German OS 34 11 079. Given the composite member of FIG. 1, the length of 90 mm selected in the measurement of the hysteresis loops of FIGS. 2 and 3 was shortened to 20 mm and the hysteresis loop was measured again. This is shown in FIG. 4. One can see from the dashed-line curve (measurement given demagnetized jacket of the iron alloy 2) that the rectangular curve shown in FIG. 2 is somewhat clipped due to the edge effects. A sudden reversal of the magnetic poles of the core thus no longer occurs.

When, however, the iron alloy is magnetized, one obtains the solid-line curve in FIG. 4 that, is horizontally shifted due to the influence of the magnetic field of the iron alloy 2, and also shows that a sudden magnetic reversal of the entire soft-magnetic material 1 occurs upon traversal in one direction since, given traversal of the hysteresis loops in this direction, the wire ends of the soft-magnetic material retain their magnetization direction under the influence of the magnetic field of the iron alloy 2 until the external magnetic field forces the sudden magnetic reversal of the soft-magnetic material 1.

In FIG. 5, the voltage is entered on the ordinate and the time in microseconds is entered on the abscissa. For producing the results shown in FIG. 5, a composite wire having a length of 20 mm was surrounded by a winding having 1000 turns. The magnetic reversal ensued on the basis of an alternating current at 50 Hz in a separate excitation coil that was arranged such that the field strength along the composite wire was 5 A/cm. One can see that a voltage pulse of approximately 0.95 V can be achieved; due to the asymmetry of the hysteresis loop in the magnetized iron alloy, however, this only occurs in every other half-wave.

FIG. 6 shows the voltage pulse of the composite member of FIG. 1 given a diameter of 0.2 mm and a length of 90 mm in a coil having 1500 turns and a length of likewise 90 mm after heating the composite member for 6 seconds to 1100° C. and subsequent cooling. In this condition, the composite member can be operated with a low drive of, for example, 0.8 A/cm since the core has a low coercive force of approximately 0.1 A/cm. The pulse thereby achieved with a magnetized iron alloy 2 is compared in FIG. 6 to that obtained using amorphous wire, as described in U.S. Pat. No. 4,660,025. Curve 4 shows the voltage pulse of the amorphous wire and curve 5 shows the voltage pulse derived with the inventively manufactured pulse generator.

Even though the iron alloy is employed as the jacket and the soft-magnetic material is employed as the core of a wire in the exemplary embodiment shown above, other materials can also be employed by plating, etc., as in the known cases. Flat, elongated composite members are obtained in an especially advantageous way by rolling the finished wire before the thermal treatment. Employing the iron alloy as a jacket offers the advantage that a rigid outer surface is obtained. However, it is also fundamentally possible to employ the iron alloy as the core of a wire or as a middle layer of a flat composite member.

When one wishes an even higher coercive field strength of the iron alloy, or a further increase in strength, the finished composite wire—following the thermal treatment of the invention—can also be annealed for at least 10 minutes at a temperature between 360 and 750° C. A coercive field strength that increases further is then also obtained together with the increase in strength of the iron alloy thereby achieved. In addition to the strength-enhancing additives that are contained in the soft-magnetic material 1 of the exemplary embodiment, the elements Nb, Ti, Al, Cu, Be, Mo, V, Zr, Si, Cr, Mn can be advantageously added to the iron alloy for increasing the strength and/or for improving the resistance to corrosion without their properties—reversible structure conversions at different temperatures with volume change—being significantly influenced.

Since only a brief-duration heating of the composite member is required, the entire wire or the entire band from which the composite members are manufactured need not be absolutely stationarily subjected to the thermal treatment; heating can also be undertaken as a continuous annealing or by conducting electrical currents therethrough.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for producing a pronounced pulse by the introduction of a pulse generator having magnetic poles into an alternating magnetic field, due to a sudden reversal of the magnetic poles of said pulse generator in said magnetic field, said method comprising the steps of:

selecting an iron alloy from a group of iron alloys which, when heated, expand in volume substantially uniformly until reaching a first temperature and thereafter exhibit diminished expansion and which, when cooled from said first temperature to room temperature, contract in volume substantially uniformly until reaching a second temperature, above room temperature, at which said iron alloys rapidly and pronouncedly expand in volume;

selecting a soft magnetic material from a group of soft magnetic materials which expand substantially uniformly when heated at least to said first temperature and which contract substantially uniformly when cooled from said first temperature to room temperature;

forming an elongated composite member of an iron alloy selected from said group of iron alloys and at least one soft magnetic material selected from said group of soft magnetic materials;

subjecting said composite member to a thermal treatment to produce said pulse generator, wherein said composite member is elevated at least to said first temperature and is subsequently cooled to room temperature for causing said iron alloy and said at least one soft magnetic material in said composite member to become mechanically stressed due to their differing expansion and contraction behavior;

generating an alternating magnetic field; and introducing said pulse generator into said magnetic field and thereby causing a reversal of the magnetic poles of said pulse generator to produce said pronounced pulse.

2. A method according to claim 1, wherein the step of selecting an iron alloy is further defined by selecting an iron alloy from said group of iron alloys wherein said second temperature is below 600° C.

3. A method according to claim 1, wherein the step of selecting an iron alloy is further defined by selecting a martensitically hardening steel as said iron alloy.

4. A method according to claim 1, wherein the step of forming an elongated composite member is defined by drawing a wire core together with a jacket surrounding the core.

5. A method according to claim 4, wherein the step of drawing is further defined by drawing a wire core composed of soft-magnetic material surrounded by a jacket composed of said iron alloy.

6. A method according to claim 1, wherein the step of subjecting said composite member to a thermal treatment is further defined by brief-duration heating the composite member to a temperature sufficiently above said first temperature to dismantle internal stresses due to recrystallization of the soft-magnetic material.

7. A method according to claim 4, wherein the step of subjecting said composite member to a thermal treatment is further defined by continuously annealing said composite member.

8. A method according to claim 4, wherein the step of subjecting said composite member to a thermal treatment is further defined by brief-duration heating said composite member by conducting electrical current therethrough.

9. A method according to claim 4, comprising the additional step, after said thermal treatment, of annealing said composite wire for at least 10 minutes at a temperature between 360° and 750° C. for enhancing the strength of the iron alloy in combination with an increase of the coercive field strength.

10. A method as claimed in claim 1 wherein the step of generating an alternating magnetic field is further defined by generating an alternating magnetic field having a field strength of 5 A/cm, and wherein the step of introducing said pulse generator into said magnetic field is further defined by introducing said pulse generator into said magnetic field and thereby causing a reversal of the magnetic poles of said pulse generator to produce a pulse having a pulse height of at least 0.95 V.

11. A method as claimed in claim 1 wherein the step of generating an alternating magnetic field is further defined by generating an alternating magnetic field having a field strength of 0.8 A/cm, and wherein the step of introducing said pulse generator into said magnetic field is further defined by introducing said pulse generator into said magnetic field and thereby causing a reversal of the magnetic poles of said pulse generator to produce a pulse having a pulse height of at least 0.28 V.

12. A method as claimed in claim 1 wherein the step of selecting an iron alloy is further defined by selecting an iron alloy from said group of iron alloys and having a composition of 5% through 25% Ni, up to 15% of one or more Co, Mo, Al and Ti, and a remainder Fe, by weight.

13. A method as claimed in claim 12 wherein the step of selecting an iron alloy is further defined by selecting an iron alloy from said group of iron alloys and having a nickel content of 10% through 20%.

* * * * *